US006715763B2

(12) United States Patent
Rudell et al.

(10) Patent No.: US 6,715,763 B2
(45) **Date of Patent: *Apr. 6, 2004**

(54) ELECTRONIC TOYS THAT ACTIVATE VIA A SIGNAL BEAM

(75) Inventors: Elliot Rudell, 30507 Rhone Dr., Rancho Palos Verdes, CA (US) 90275; George T. Foster, Long Beach, CA (US); Ian B. Osborne, Gardena, CA (US)

(73) Assignee: Elliot Rudell, Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/113,667

(22) Filed: Mar. 27, 2002

(65) Prior Publication Data

US 2002/0109299 A1 Aug. 15, 2002

Related U.S. Application Data

(63) Continuation-in-part of application No. 09/590,479, filed on Jun. 8, 2000, now Pat. No. 6,422,566.
(60) Provisional application No. 60/178,900, filed on Jan. 28, 2000.

(51) Int. Cl.[7] ..... A63B 67/00

(52) U.S. Cl. ..... 273/445; 273/349
(58) Field of Search ..... 273/349, 457, 273/445; 463/5, 50; 434/22; 222/79; 446/405

(56) References Cited

U.S. PATENT DOCUMENTS

| | | | | |
|---|---|---|---|---|
| 3,008,712 | A | | 11/1961 | Konopka |
| 3,843,127 | A | | 10/1974 | Lack |
| 4,040,622 | A | | 8/1977 | Sinnott |
| 4,077,629 | A | | 3/1978 | Chestney |
| 4,545,583 | A | | 10/1985 | Pearman et al. |
| 4,772,028 | A | | 9/1988 | Rockhold et al. |
| 5,611,460 | A | * | 3/1997 | Rudell ..... 222/78 |
| 5,785,592 | A | | 7/1998 | Jacobsen |
| 5,823,849 | A | | 10/1998 | Gardner et al. |
| 5,893,562 | A | | 4/1999 | Spector |
| 5,984,788 | A | * | 11/1999 | Lebensfeld et al. ..... 463/51 |
| 6,422,566 | B1 | * | 7/2002 | Rudell et al. ..... 273/445 |
| 6,533,282 | B2 | * | 3/2003 | Rudell et al. ..... 273/445 |

* cited by examiner

*Primary Examiner*—Raleigh W. Chiu
(74) *Attorney, Agent, or Firm*—Irell & Manella LLP

(57) ABSTRACT

A game set that includes first and second guns that can be activated. The second gun is not activated if the first gun is activated before the second gun.

17 Claims, 7 Drawing Sheets

FIG. 7
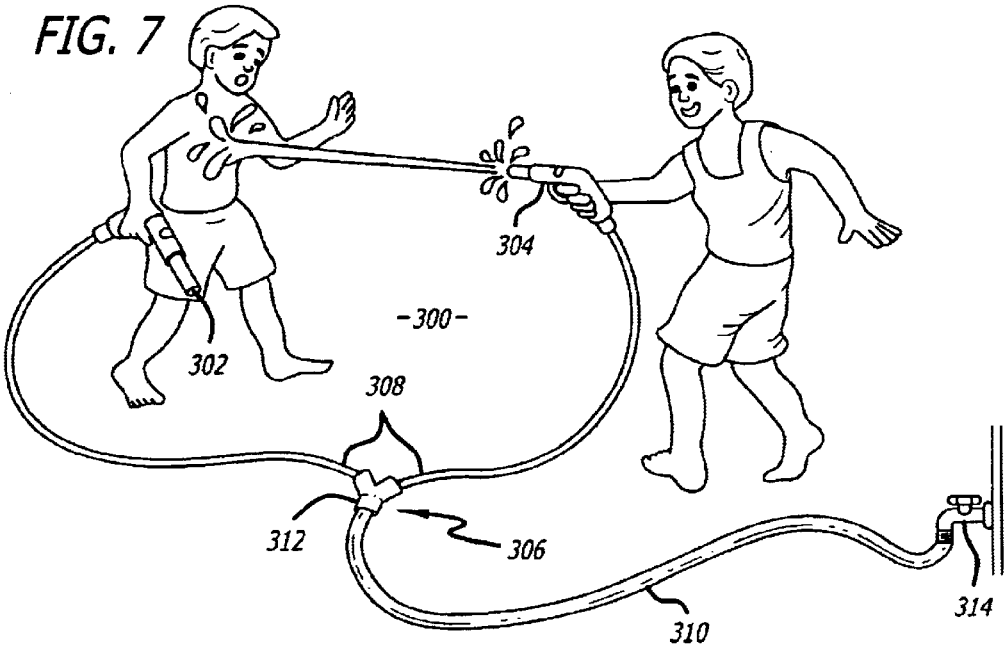
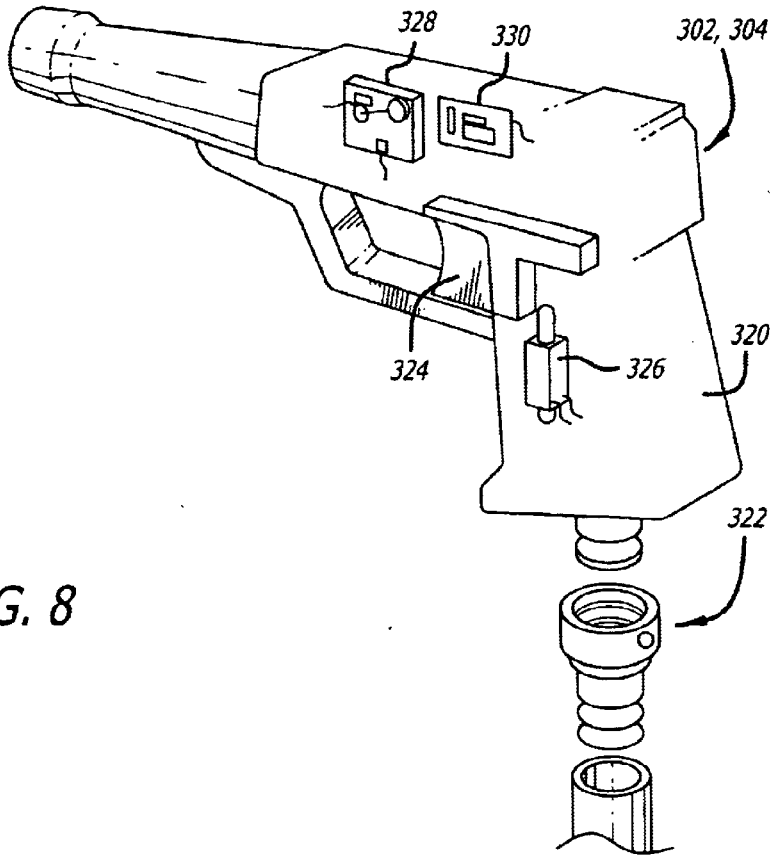
FIG. 8

ELECTRONIC TOYS THAT ACTIVATE VIA A SIGNAL BEAM

REFERENCE TO CROSS-RELATED APPLICATIONS

This application is a continuation-in-part of application Ser. No. 09/590,479, filed Jun. 8, 2000, U.S. Pat. No. 6,422,566, which claims priority to provisional Application No. 60/178,900, filed Jan. 28, 2000.

BACKGROUND OF THE INVENTION

1. Field of the Invention

The present invention relates to electronically controlled guns that are used in a game of draw.

2. Prior Art

There have been marketed numerous battery operated water guns. For example, Larami Corporation marketed a line of battery powered water guns under the name ENTERTECH. The ENTERTECH guns contained motor driven pumps that created a water pressure greater than pressure found in manually pressurized guns. Consequently, battery operated water guns were capable of projecting water farther than manually pressurized guns.

Toymax marketed a battery powered game set under the trademark CYBER SPLASH. The CYBER SPLASH game set included light sensitive targets integrated into vests that were worn by the players of the game. Each player would shoot a light beam onto the target worn by another player with a light gun. Water was released onto the player wearing a vest that was hit 10 times by the light beam of an opposing player.

U.S. Pat. No. 5,823,849 issued to Gardner et al. discloses a game set that contains a pair of battery powered water squirting shields. Each shield contains a water sensor that is coupled to a controller. When an opposing player is successful in hitting the sensor a predetermined number of times the controller closes a valve so that water cannot be emitted from the shield. This prevents that player from squirting another player. The player holding the shield is thereby penalized for allowing an opposing player to successfully hit the sensor.

There have also been marketed various types of water guns. By way of example, Larami Corp. sold a water gun under the trademark SUPER SOAKER. The SUPER SOAKER could emit a highly pressurized stream of water over a relatively long distance.

With the guns and game sets of the prior art each player can shoot the other player without any time constraints. It would be desirable to provide a gun game set that introduced time as a constraint to spraying an opponent.

BRIEF SUMMARY OF THE INVENTION

A game set that includes first and second guns that can be activated. The second gun is not activated if the first gun is activated before the second gun can be activated.

BRIEF DESCRIPTION OF THE DRAWINGS

FIG. 7 is a perspective view of another embodiment of the game set;

FIG. 8 is a perspective view of a spray device of the game set shown in FIG. 7;

DETAILED DESCRIPTION

Figure 1:
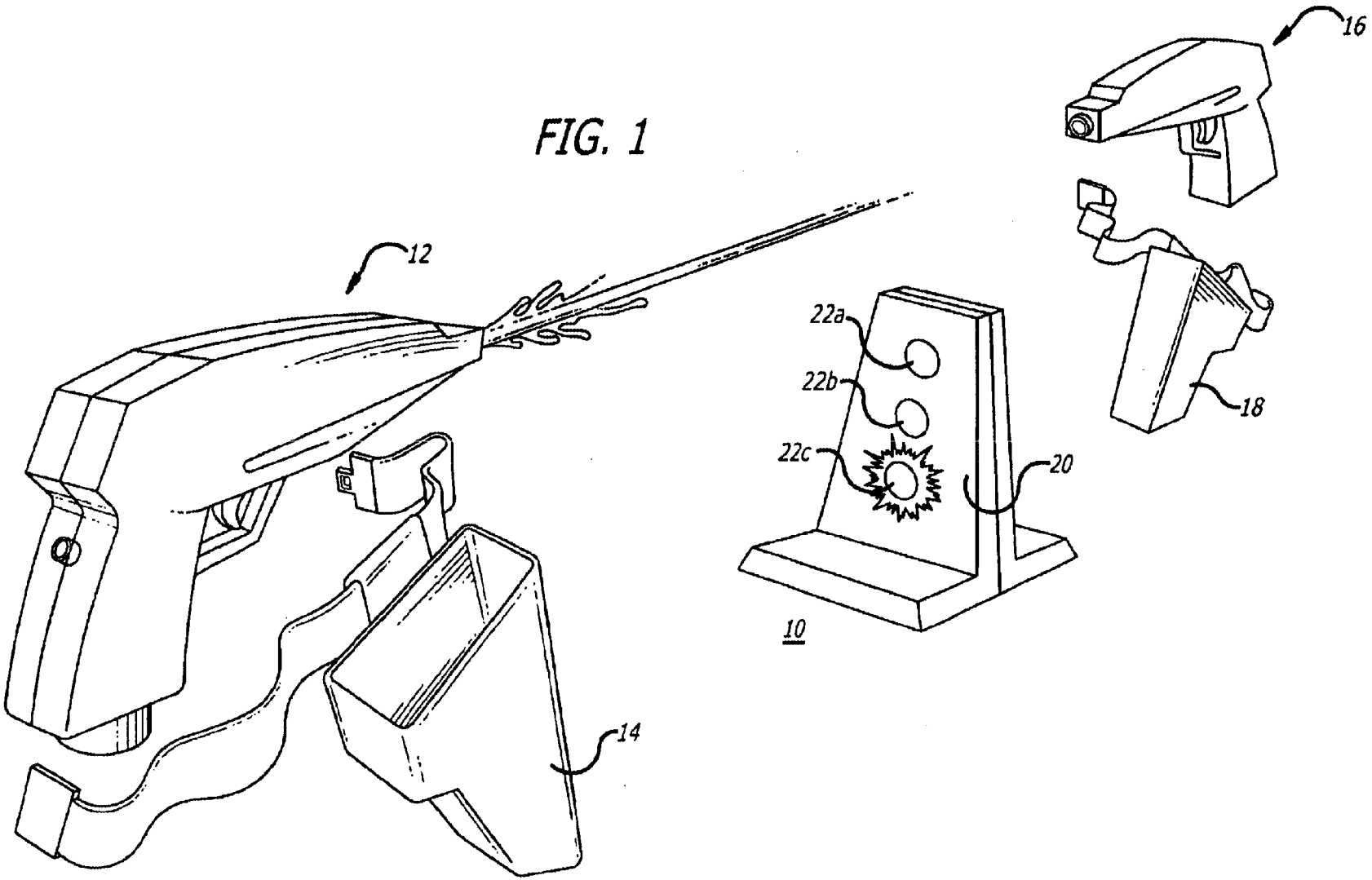
FIG. 1 is a perspective view of a game set.

Referring to the drawings more particularly by reference numbers, FIG. 1 shows an embodiment of a game set 10. The game set 10 includes a first spray device 12 that can be drawn from a first holster 14 and a second spray device 16 which can be drawn from a second holster 18. The spray devices 12 and 16 are each adapted to spray a fluid such as water.

The spray devices 12 and 16 can be drawn from the holsters 14 and 18 in conjunction with a signal device 20. The signal device 20 may have a first light source 22*a*, a second light source 22*b* and a third light source 22*c* that are sequentially illuminated to provide an indication, or "GO" signal, of when to draw the spray devices 12 and 16 from the holsters 14 and 18, respectively. For example, the first light source 22*a* may become illuminated, followed by the second light source 22*b* and the third light source 22*c*. Illumination of the third light source 22*c* may provide an indication that the players can draw the spray devices 12 and 16 from the holsters 14 and 18, respectively. If a player draws a spray device 12 or 16 before the third light source 22*c* is illuminated the spray device is not activated and the player cannot spray water. Additionally, the player who draws a spray device 12 or 16 last will not be able to activate his spray device so that he cannot spray the other player.

Figure 2:
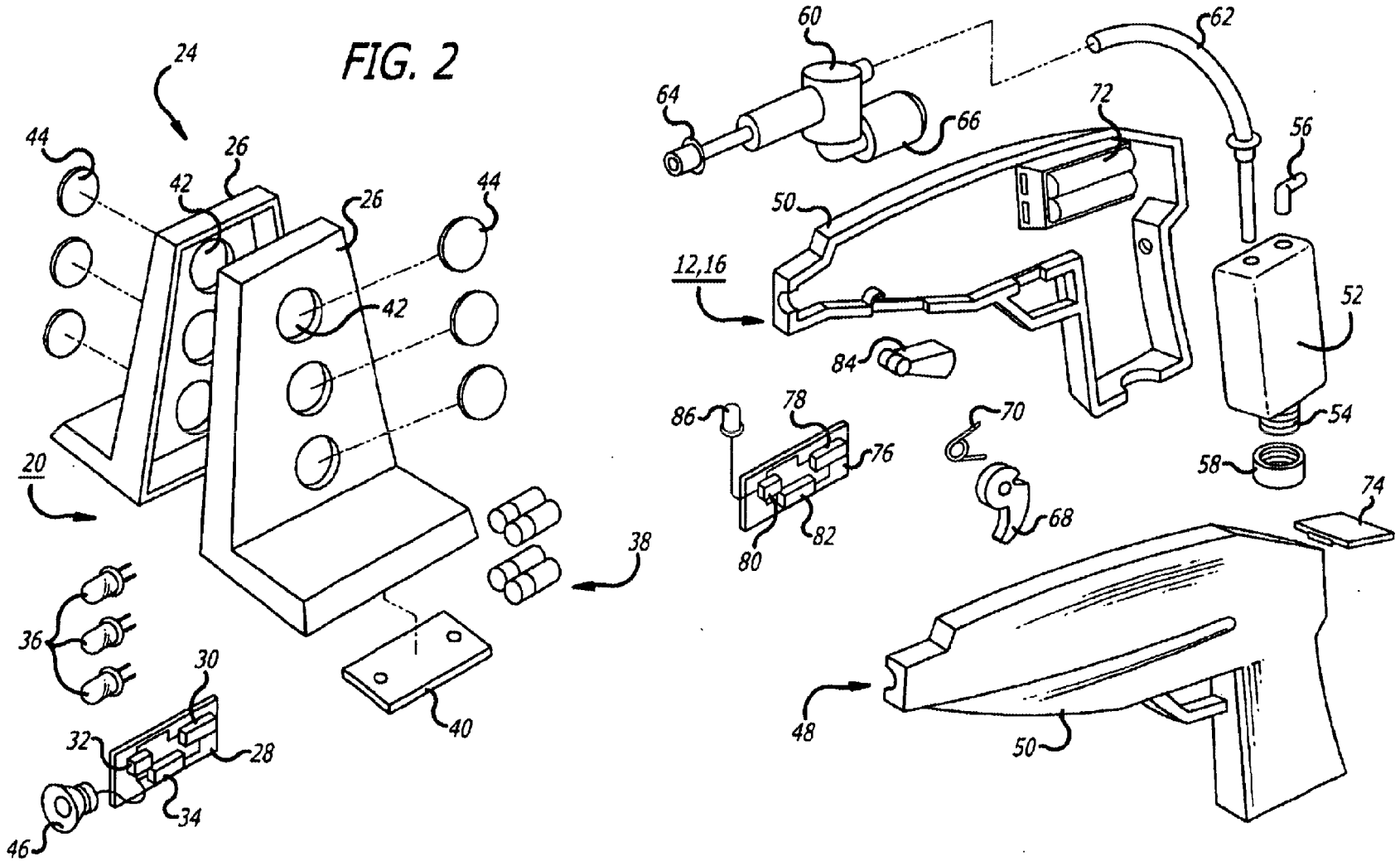
FIG. 2 is an exploded view of a signal device and a spray device of the game set.

FIG. 2 shows an embodiment of a spray device 12 or 16 and the signal device 20. The signal device 20 may include a housing 24 constructed from two separate molded plastic parts 26. The housing 24 may contain a printed circuit board assembly 28 that contains one or more electrical circuits. By way of example, the electrical circuits may include a controller 30, a memory 32 and a transceiver 34. The transceiver 34 may transmit and receive signals to and from the spray device 12 or 16. Although a transceiver 34 is described, it is to be understood that a transmitter can be substituted for the transceiver so that the signal device only transmits signals. The controller 30 may be a processor, discrete logic circuits or any combination of circuits to perform the logical computations required to operate the game set 10.

The signal device 20 may include light emitting diodes (LEDs) 36 that correspond to the light sources 22*a*, 22*b* and 22*c* shown in FIG. 1. The LEDs 36 may be coupled to the controller 30 and a plurality of batteries 38. The controller 30 may provide a switching function to control current from the batteries 38 to the LEDs 36 and selectively illuminate the light sources.

The batteries 38 may be enclosed within the housing 24 by a removable lid 40. The LEDs 36 may be located within openings 42 in the housing 24 and enclosed by lenses 44. Each lens 44 may have a different color. The signal device 20 may also include a speaker 46 that is coupled to the controller 30. The controller 30 may generate signals that create audible sounds such as speech through the speakers. By way of example, the speech may compliment the illumination of the light sources such as "two, one, GO".

Each spray device 12 or 16 may include a housing 48 constructed from two separate molded plastic parts 50. The housing 48 may contain a tank 52 that can be filled with a fluid such as water through a tank opening 54. The tank 52 may further have a vent 56 and can be sealed by a cap 58.

The tank 52 can be connected to a pump 60 by a tube 62. The pump 60 is connected to a nozzle 64. The pump 60 is driven by a motor 66. The pump 60 contains a valve (not shown) that is controlled by a trigger 68. The trigger 68 is biased to an open position by a spring 70. Fluid will flow from the nozzle 64 when the motor 66 is activated and the trigger 68 is depressed. The motor 66 is powered by a plurality of batteries 72 enclosed by a battery lid 74. Although a pump 60 and motor 66 are shown and described, it is to be understood that other types of pressurization devices may be employed. For example, the gun may have an inflatable bladder or a manually activated pump.

Each spray device 12 or 16 may have a printed circuit board assembly 76 that includes a plurality of electrical circuits such as a controller 78, a memory 80 and a transceiver 82. The controller 78 could be a processor, discrete logical circuits or any combination of circuits to perform the logical computations required to operate the game set. The printed circuit board assembly 76 is connected to both the motor 66 and the batteries 72. The transceiver 82 can transmit and receive signals from the signal device 20. The controller 78 can provide a switch function to switch the motor 66 between active and inactive states. The controller 78 can also be coupled to a holster switch 84 to detect when the spray device is located within a holster, or drawn from a holster. The spray device 12 or 16 may further have a power on light source 86.

The controllers 30 and 78 may perform logical computations and control the light sources 22*a*, 22*b* and 22*c*, and active/inactive state of the device motors 66, based on interactive inputs and outputs from the signal device 20 and spray devices 12 and 16. By way of example, the controllers 30 and 78 can operate in the following manner.

When the spray devices 12 and 16 are located within the holsters 14 and 18, respectively, the controllers 78 of the devices 12 and 16 will cause the transceivers 82 to emit "in-holster" signals to the signal device 20. Upon receiving the in-holster signals the controller 30 may begin a countdown sequence. The light sources 22*a*, 22*b* and 22*c* are sequentially illuminated during the countdown sequence.

The controller 78 of each spray device 12 and 16 detects when a player removes the device 12 or 16 from the holster 14 or 18 by means of the holster switch 84. The controller 30 then generates a draw signal that is transmitted to the signal device 20. The signal device 20 transmits an encoded signal when the GO signal (illumination of light source 22*c*) is provided. The signal device 20 is capable of providing two different signals. Each signal contains an address or other code unique to one of the spray devices 12 and 16. Receipt of the encoded signal will cause the controller 78 to activate the motor 66 and allow a player to spray fluid from the device 12 or 16.

If a spray device 12 or 16 does not receive an encoded signal the motor 66 of that device remains inactive. The controller 78 may switch the motor 66 to the active state after a predetermined interval so that the player can squirt water. Although activation and inactivation of the motor 66 is described, the ability to emit water from the gun may be controlled by a solenoid (now shown) that can lock and unlock the trigger 68. The solenoid may be controlled by the controller 78.

The controller 30 of the signal device 20 will determine whether a draw signal was received from a spray device before the end of the countdown sequence. The controller 30 will not provide an encoded signal to a spray device that emits a draw signal before the end of the countdown sequence. If both spray devices 12 and 16 are drawn after the countdown sequence has ended, then the controller 30 determines which spray device first transmitted a draw signal and then provide a coded signal only to that device. This allows only one player to squirt the other player with water thus creating a penalty by not drawing fast enough.

As an alternative method the signal device 20 may only have a transmitter that transmits a signal(s) to both spray devices 12 and 16 at the end of the countdown sequence. The controller 78 of the spray device that senses both the transmitted signal and the withdrawal of the device from the holster, may then transmit a inactivation signal to the other spray device to inactivate the motor of the other device.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

For example, the game set may not have a signal device 20. With such an embodiment only the player who pulls their gun out of the holster first can spray water. By way of example, all guns may be activated when the guns are placed in the holsters. The gun that is drawn first may send an inactivation signal to inactivate, or prevent activation, of the other gun(s). The inactivated gun may again become activated after a certain time interval. This allows the players to squirt water even when they are not playing a game of draw. The guns may also have a lock/unlock switch (not shown) that allows a player to squirt water even when not playing a game of draw.

Figure 3:
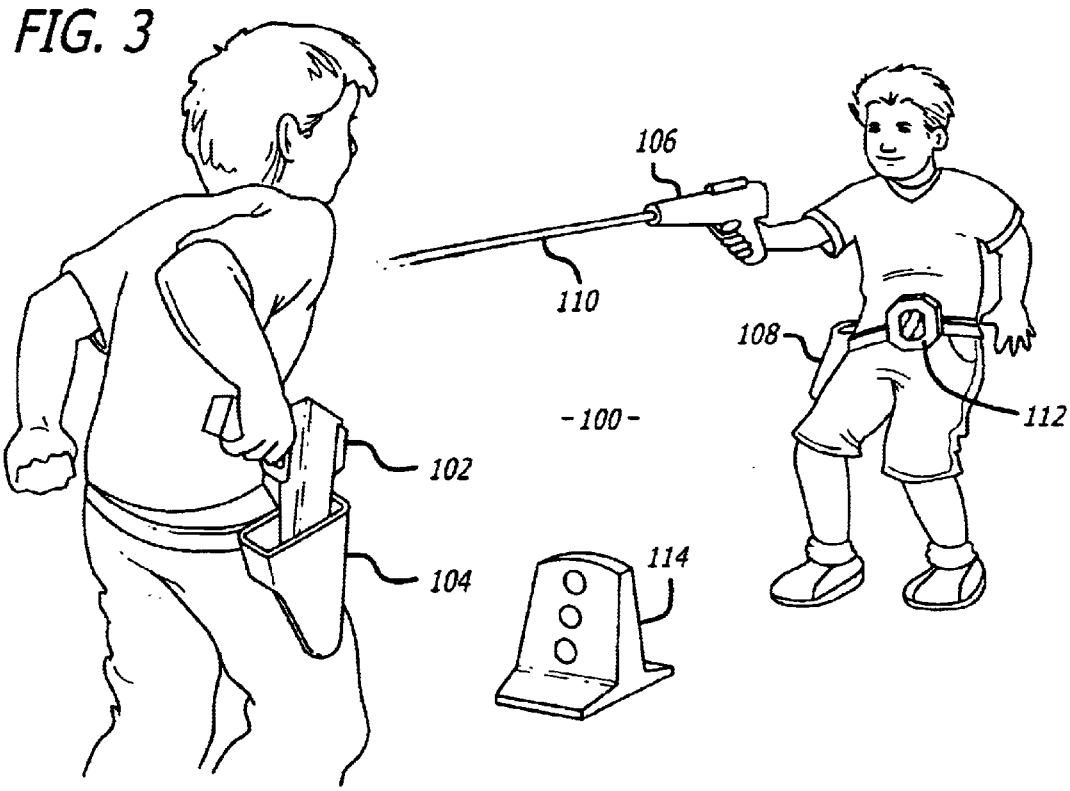
FIG. 3 is a perspective view of another embodiment of a game set.

Alternatively, one of the guns may transmit a synchronization signal that causes both guns to initiate a counter. The guns cannot be activated until the counters countdown. This prevents a player from prematurely drawing their gun. Again, the last player to draw will be unable to activate their gun, FIG. 3 shows a game set 100 having a first toy gun 102 that can be placed in a first holster 104 and a second toy gun 106 that can be placed in a second holster 108. Instead of water the guns 102 and 106 can emit beams of light 110. Each player may wear a light sensor 112 that can detect a light beam 110. The light sensor 112 may include an audio system (not shown) that emits a sound when the sensor 112 detects light. The game may thus provide audio feedback when one player successfully hits the sensor 112 of another player. The light sensor 112 may also include a counter to count the number of times a player has successfully "hit" another player. The light sensors 112 may contain electronics that communicate with a signal device 114. Alternatively, the guns 102 and 106 may contain all or some of the electronic devices.

The game set 100 shown in FIG. 3 may operate in the same manner as the game 10 shown in FIGS. 1 and 2. The signal device 114 provides a signal to draw the toy guns 102 and 106. The toy gun 102 or 106 drawn first will be active, the other toy gun 106 or 102 will be inactivated.

Figure 4:
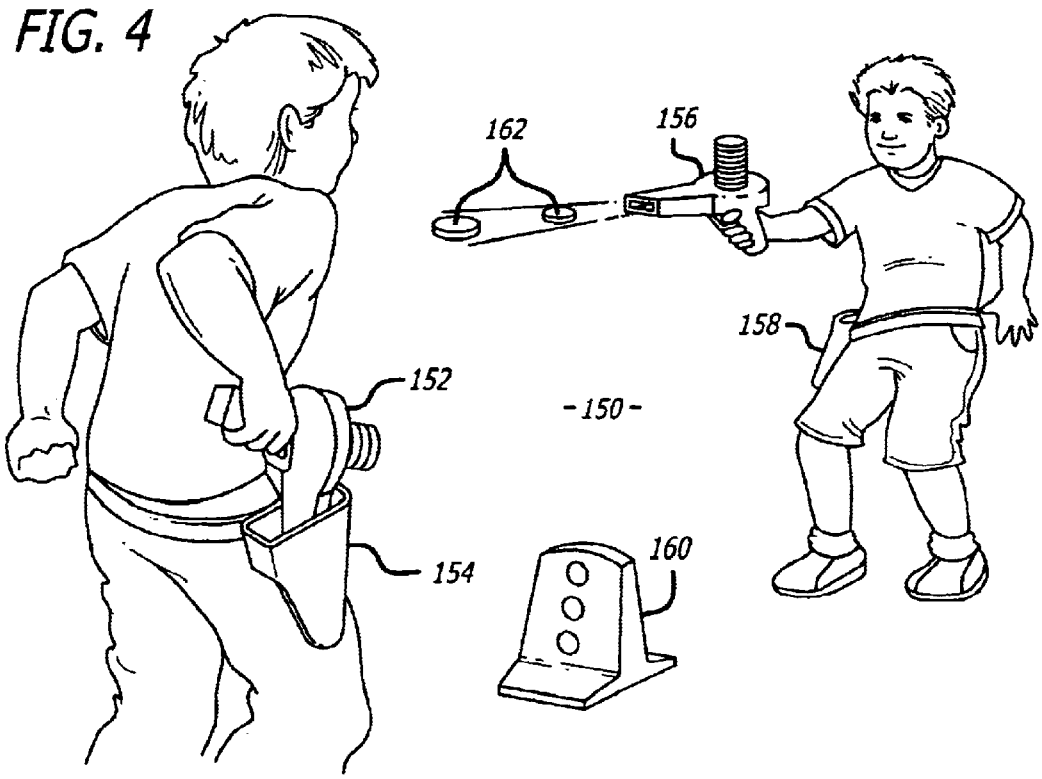
FIG. 4 is a perspective view of another embodiment of a game set.

FIG. 4 shows a game set 150 that includes a first toy gun 152 that can be drawn from a first holster 154, and a second toy gun 156 that can be drawn from a second holster 158. The game set 150 may further include a signal device 160. Each toy gun 152 and 156 can eject a projectile 162. The projectile 162 may be a foam disk. The game set 150 may operate in the same manner as the game 10 shown in FIGS. 1 and 2.

Figure 5:
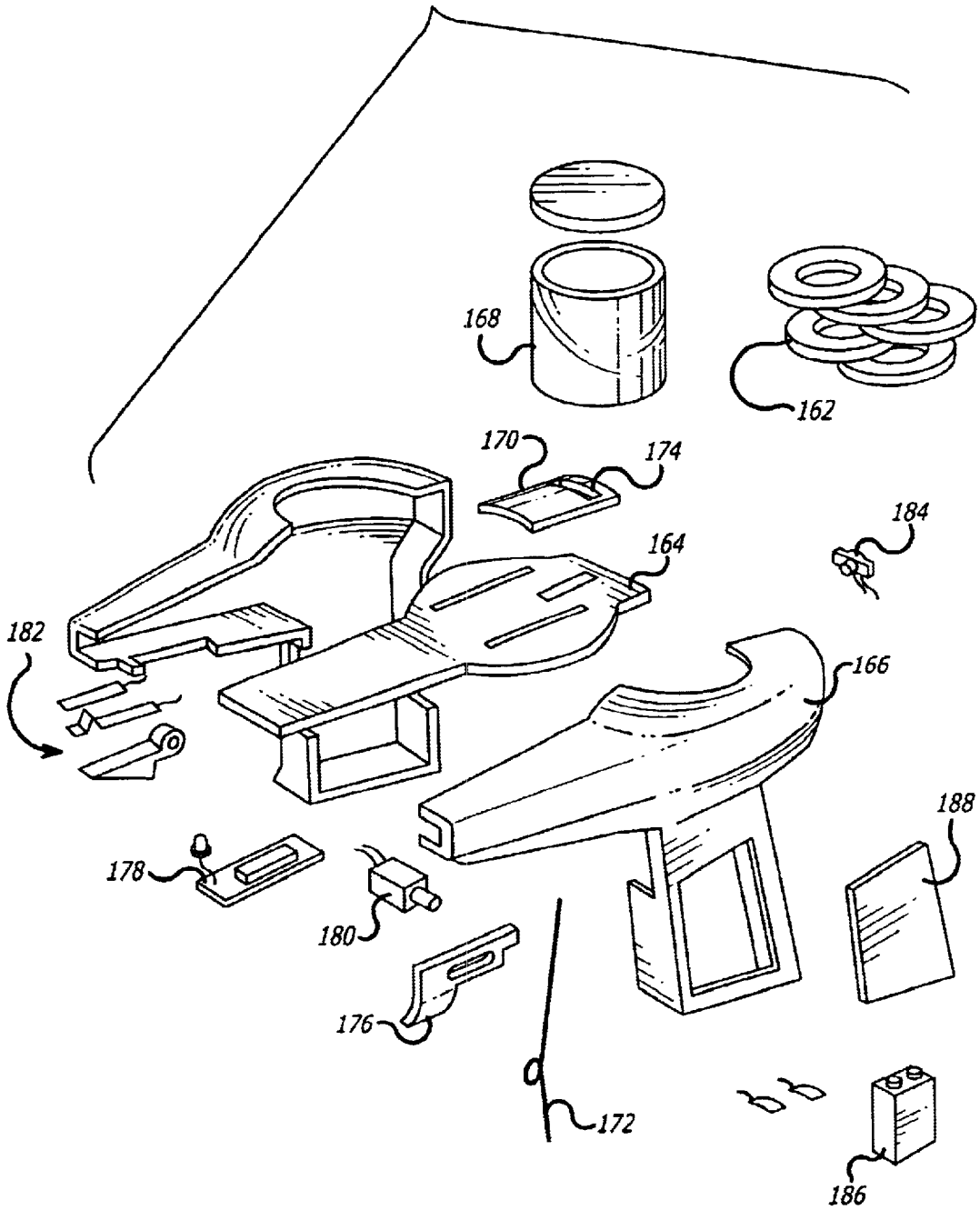
FIG. 5 is an exploded view of an embodiment of the toy gun shown in FIG. 4.

FIG. 5 shows an embodiment of a toy gun 152, 156. The gun 152, 156 may include a platform 164 that is attached to a housing 166. The gun 152, 156 may also include a canister 168 that holds a plurality of projectiles 162.

The gun 152, 156 may include a launching plate 170 that can eject a projectile 162. The launching plate 170 is moved by a spring 172 that is attached to an aperture 174 of the plate 170. The spring 172 is attached to a trigger 176 that can be depressed by a player. Depressing the trigger 176 causes the spring 172 to deflect and move the launching plate 170 rearward. The player continues to depress the gun trigger 176 until the spring 172 disengages from the trigger 176 to move the plate 170 forward and eject a projectile 162.

The gun 152, 156 may include a printed circuit board assembly 178 that contains the electrical circuits required to operate the game. The circuit board 178 may be connected to a solenoid 180 that can be actuated to lock the trigger 176 and thereby inactivate the gun 152, 156. The gun 152, 156 may also include a contact sensor 182 that is coupled to the printed circuit board assembly 178 and senses when the gun 152, 156 is pulled from a holster 154, 158.

The gun 152, 156 may further include an on/off switch 184 and battery assembly 186 coupled to the printed circuit board assembly 178. The battery assembly 186 may be enclosed by a cover plate 188.

Figure 6:
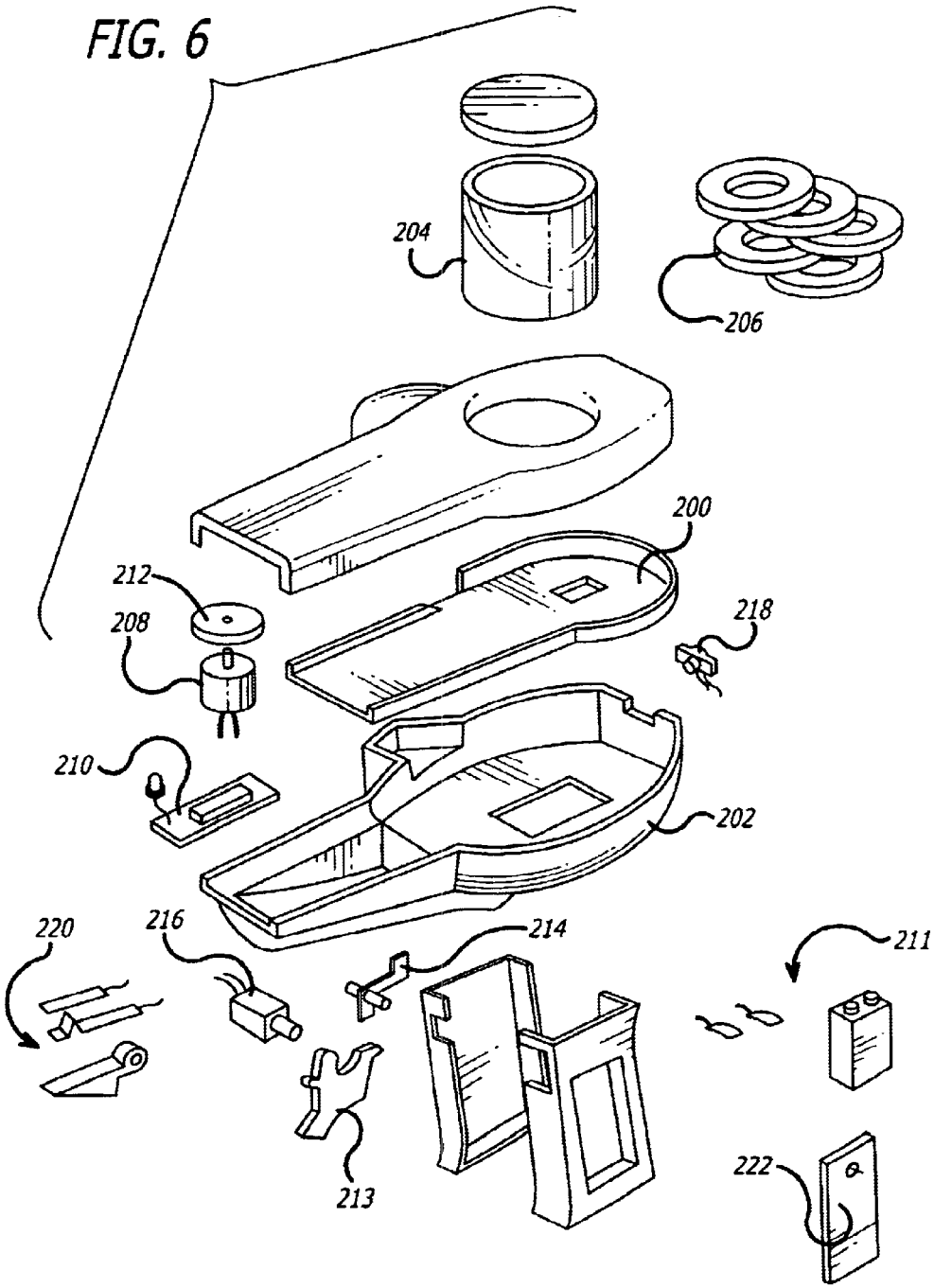
FIG. 6 is an exploded view of an embodiment of a toy gun shown in FIG. 4.

FIG. 6 is another embodiment of the guns 152' and 156'. This embodiment includes a launching platform 200 attached to a housing 202. The gun 152', 156' also has a canister 204 that is attached to the housing 202 and holds a plurality of projectiles 206. The gun 152', 156' includes an electric motor 208 that is coupled to a printed circuit board assembly 210 and a battery assembly 211. The motor 208 has a drive wheel 212 that spins and ejects a projectile 206 from the gun 152', 156'.

The gun 152', 156' includes a trigger 213 coupled to both the housing 202 and an ejector arm 214. Depressing the trigger 213 will cause the ejector arm 214 to push a projectile 206 into contact with the drive wheel 212. The drive wheel 212 then spins and ejects a projectile 206. The trigger 213 may be locked by an actuator 216 attached to the printed circuit board assembly 210 to inactivate the gun 152', 156'.

The gun 152', 156' may include an on/off switch 218 and a contact sensor assembly 220 that are connected to the printed circuit board 210. The contact sensor 220 senses the removal of the gun 152', 156' from a holster 154, 158. The battery assembly 211 may be enclosed by a cover plate 222.

FIG. 7 shows another game set 300 that has a first spray device 302 and a second spray device 304. The spray devices 302 and 304 can be coupled to a garden hose assembly 306. The assembly 306 may include a pair of hoses 308 connected to a main hose 310 by a "Y" splitter fitting 312. The hose 310 can be attached to a water spigot 314.

Each spray device 302 and 304 has a trigger, valve, etc. for controlling the flow of water through the device. The spray devices 302 and 304 may further have motion sensors, such as an attitude sensor,(not shown) that sense movement of the devices 302 and 304. The devices 302 and 304 contain electrical control circuits so that the game set 300 operates as follows.

When one of the players moves a spray device 302 or 304 to a "shooting" position, the sensor senses this movement and activates the device 302 or 304 so that the player can pull the trigger and emit water. The spray device 302 or 304 that is moved to the shooting position first transmits a inactivation signal to inactivate the other device 304 or 302. The other device 304 or 302 can be unset from the inactivated state after a predetermined time interval.

FIG. 8 shows an embodiment of a spray device 302, 304. The device 302, 304 includes a housing 320 that has a fitting assembly 322 which allows attachment to a hose 308. The device 302, 304 also has a trigger 324 that is coupled to a valve (not shown). Pulling the trigger 324 will allow water to be emitted from the device 302, 304. The trigger 324 can be locked into an inactive state by a solenoid 326. The device 302, 304 contains a motion sensor 328. By way of example, the motion sensor may include a mercury switch or other type of attitude sensor. The motion sensor 328 and solenoid 326 are coupled to a printed circuit board assembly 330. The circuit board assembly 330 may have transceiver circuits that transmit and receive signals from the other device.

In operation, a user moves a device 302, 304 to a "shooting" position. The circuit board assembly 330 switches the state of the solenoid 326 so that the user can pull the trigger 324 and squirt pressurized water. If the other player has moved their device 304 or 302 to a shooting position first, the circuit board 330 receives a inactivation signal which causes the solenoid 326 to lock the trigger 324 and prevent the player from squirting water. In this instance the player has lost the draw.

Figure 9:
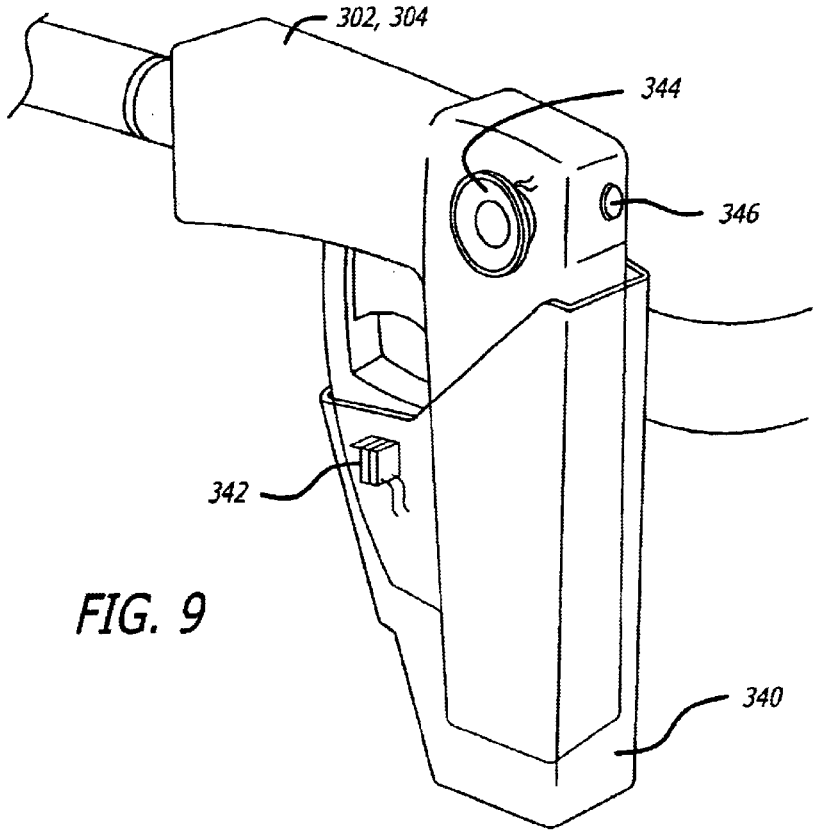
FIG. 9 is a perspective view of an alternate embodiment of a spray device.

FIG. 9 shows another embodiment wherein a spray device 302', 304' is positioned in a holster 340. The spray device 302', 304' includes a contact switch 342 that can detect when the device 302', 304' is pulled from the holster 340. Operation of the spray devices 302', 304' is similar to the game set shown in FIGS. 1 and 2, although it is understood that the signal device is not required to play the game. The device 302', 304' may also include a speaker 344 and an indicator light 346.

Although a spray device is shown, it is to be understood that the devices 302 and 304 can be modified to emit light or a projectile. Such a game set would not require a signal device and/or holsters.

Figure 10:
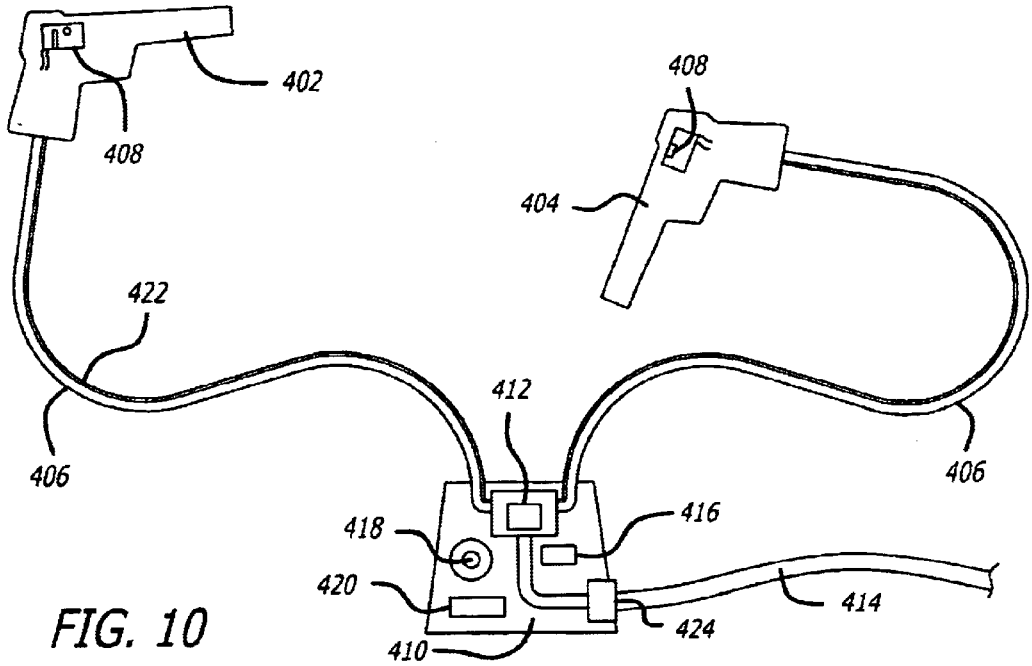
FIG. 10 is an illustration of an alternate embodiment of a game set.

FIG. 10 shows yet another embodiment of a game set similar to the set shown in FIG. 7. The game set includes a pair of devices 402 and 404 that are connected to hoses 406. Each device includes a motion sensor 408. In this embodiment, the Y fitting 410 includes a solenoid valve 412 to control the flow of water to the devices 402 and 404 from a garden hose 414. The fitting 410 may also include a printed circuit board assembly 416, a speaker 418 and a battery assembly 420. The Y fitting 410 may be electrically connected to the motion sensors 408 by wires 422 attached to the hoses 406. The garden hose 414 may be connected to a threaded port 424 of the Y fitting 410.

In operation, each player "draws" a device 402 and 404. The motion sensors 408 detect the movement of the devices 402 and 404 and provides corresponding signals to the printed circuit board assembly 416. The printed circuit board 416 provides an output signal(s) to switch the solenoid valve 412 so that the device 402 or 404 drawn first receives water. This state of the valve 412 prevents water from flowing to the other device 404 or 402. After a predetermined time interval the printed circuit board 416 drives the valve 412 to a state that shuts off water to both devices 402 and 404.

It is to be understood that the game set shown in FIG. 10 may also include the holsters and the signal device shown in FIGS. 1 and 2.

What is claimed is:

1. A game set that can be played by at least two opposing players, comprising:

a first holster;

a first gun that can be removed from said first holster;

a second holster; and, a second gun that is activated too shoot an opposing player if removed from said second holster before said first gun is removed from said first holster.

2. The game set of claim 1, wherein said first and second guns transmit a signal when said first and second guns are within said first and second holsters, respectively.

3. The game set of claim 2, further comprising a signal device that includes a counter that counts to a predetermined value when said signal device receives said signal, said signal device provides a draw signal to indicate a time to remove said first and second guns from said first and second holsters, respectively.

4. The game set of claim 3, wherein said signal device transmits an encoded signal only to said first or second gun.

5. The game set of claim 3, wherein said signal device includes a plurality of light sources that are sequentially illuminated in conjunction with the count of said counter to provide said draw signal.

6. The game set of claim 3, wherein said first gun transmits an inactivation signal to said second gun to inactivate said second gun.

7. The game set of claim 1, wherein said second gun is inactivated if removed from said second holster before said draw signal.

8. The game set of claim 1, wherein said first and second guns each include a holster switch coupled to an electrical circuit and which can engage said holsters.

9. The game set of claim 3, wherein said signal device includes a speaker.

10. A game set, comprising:

a signal device that contains a transmitter which transmits an encoded signal; and, a gun which has a receiver that can receive said encoded signal from said signal device, said gun can be switched between an active state and an inactive state in response to receiving the encoded signal from said signal device.

11. The game set of claim 10, wherein said gun is in the active state when the encoded signal is received from said signal device.

12. The game set of claim 10, wherein said signal device includes a counter and a plurality of light sources that are subsequentially illuminated in conjunction with a count of said counter to provide the encoded signal.

13. The game set of claim 10, further comprising a holster that can hold said gun.

14. A method for playing a game of draw, between at least two opposing players, comprising:

generating a signal;

drawing a first gun from a first holster;

drawing a second gun from a second holster after the first gun is drawn from the first holster;

activating said first gun to shoot an opposing player; and, disabling said second gun to prevent shooting an opposing player.

15. The method of claim 14, wherein the signal is an illuminated light source.

16. The method of claim 15, wherein a series of light sources are sequentially illuminated before the signal.

17. The method of claim 14, wherein the second gun is inactivated if the second gun is drawn from the second holster prior to the signal.

* * * * *